United States Patent [19]

Henkin et al.

[11] Patent Number: 4,982,459

[45] Date of Patent: Jan. 8, 1991

[54] ADJUSTABLE AIR AND WATER ENTRAINMENT HYDROTHERAPY JET ASSEMBLY

[76] Inventors: Melvyn L. Henkin, 5011 Donna Ave., Tarzana, Calif. 91356; Jordan M. Laby, 3038 Bayshore, Ventura, Calif. 93001

[21] Appl. No.: 170,718

[22] Filed: Mar. 21, 1988

Related U.S. Application Data

[63] Continuation-in-part of Ser. No. 64,138, Jun. 19, 1987, Pat. No. 4,731,887.

[51] Int. Cl.[5] ..... A61H 33/02; E03C 1/02

[52] U.S. Cl. ..... 4/541; 4/492; 4/496; 4/542; 4/544; 128/66

[58] Field of Search ..... 4/496, 492, 542, 541, 4/544, 497, 491, 504, 559, 490; 239/428, 428.5; 128/66

[56] References Cited

U.S. PATENT DOCUMENTS

| | | | |
|---|---|---|---|
| 3,287,741 | 11/1966 | Nash | 4/544 |
| 3,345,982 | 10/1967 | Guiler | 4/559 X |
| 3,605,131 | 9/1971 | Brazel et al. | 4/491 |
| 3,977,027 | 8/1976 | Speck | 4/491 |
| 4,402,094 | 9/1983 | Sanders | 4/504 |
| 4,416,030 | 11/1983 | Reynoso | 4/496 |
| 4,422,191 | 12/1983 | Jaworski | 4/496 |
| 4,502,168 | 3/1985 | Jaworski | 4/496 |
| 4,508,665 | 4/1985 | Spinnett | 4/542 X |
| 4,525,881 | 7/1985 | Higginbotham | 4/541 X |
| 4,541,780 | 9/1985 | Moreland | 4/541 X |
| 4,542,854 | 9/1985 | Mathis | 4/492 X |
| 4,593,420 | 6/1986 | Tobias et al. | 4/496 |
| 4,671,463 | 6/1987 | Moreland et al. | 4/542 X |
| 4,731,887 | 3/1988 | Henkin et al. | 4/544 X |

*Primary Examiner*—Harvey C. Hornsby
*Assistant Examiner*—Scott J. Haugland
*Attorney, Agent, or Firm*—Freilich, Hornbaker & Rosen

[57] ABSTRACT

A hydrotherapy jet assembly capable of operating in either an entrainment mode and/or a tub water entrainment mode. The assembly incorporates a valve means including a rotatable control member which allows a user to selectively vary the amount of supplied water jet and/or air available for entrainment and/or tub water available for entrainment.

36 Claims, 10 Drawing Sheets

ADJUSTABLE AIR AND WATER ENTRAINMENT HYDROTHERAPY JET ASSEMBLY

RELATED APPLICATIONS

This application is a continuation-in-part of U.S. application No. 064,138 filed June 19, 1987, now U.S. Pat. No. 4,731,887, whose disclosure is by reference incorporated

BACKGROUND OF THE INVENTION

This invention relates generally to hydrotherapy and more particularly to hydrotherapy jet assemblies intended for installation in the walls of water tubs, typically referred to as spas, hot tubs, jetted bathtubs, etc.

Applicants' parent application Ser. No. 064,138 discusses the common use of ambient air entrainment in conventional hydrotherapy jet assemblies to discharge a high velocity water/air stream for the dual purpose of creating turbulence in the tub water pool and impacting against a user's body. The application points out that air entrainment unfortunately lowers the pool water temperature and thus frequently requires heater intervention and/or hot water replacement to maintain user comfort. In order to avoid this, and additionally to reduce the noise level characteristic of conventional hydrotherapy jet assemblies, applicants' parent application discloses an improved jet assembly which utilizes tub water entrainment, rather than air entrainment, to produce the discharge stream. The assembly is characterized by the inclusion of a passageway communicating the tub water with a mixing chamber within the assembly. This allows a high pressure water jet supplied to the mixing chamber to entrain the tub water for discharge into the tub through a tubular flow director, more typically referred to as an "eyeball".

The preferred embodiment disclosed in applicants' parent application includes a manually adjustable valve member which enables the user to vary the amount of tub water entrained by the supplied water jet to thus adjust the intensity of the discharge stream.

Certain prior art air entrainment jet assemblies also include means for adjusting the discharge stream intensity, e.g. by varying the amount of jet water supplied and/or the amount of air available for entrainment. One such jet assembly is disclosed in U.S. Pat. No. 4,541,780 which teaches controlling the flow of water and air by controlling the movement of a single valve mechanism. A feature of that assembly is that the air passageway can never be significantly opened when the water supply passageway is not opened sufficiently to create a lower pressure in the mixing chamber than is present in the air supply line. This avoids malfunction when multiple assemblies are coupled for ganged operation.

SUMMARY OF THE INVENTION

The present invention is directed to hydrotherapy jet assemblies capable of operating in an air entrainment mode and/or a tub water entrainment mode.

In accordance with a significant aspect of the invention, a hydrotherapy jet assembly is provided incorporating valve means for adjusting the amount of air entrainment and/or water entrainment and/or supplied water jet to selectively vary the intensity of the stream discharged from the jet assembly.

In accordance with a further significant aspect of the invention, the aforementioned valve means includes a single control member for manually adjusting the respective amounts of air entrainment and/or water entrainment and/or supplied water jet.

In accordance with a preferred embodiment of the invention, the control member is coupled to a valve body mounted both for rotation and axial movement within a housing comprised of an aerator body and wall fitting. The housing includes a water supply nozzle having an inlet end communicating with a water supply port in the housing and an outlet end for supplying the water jet into a mixing chamber. The housing also includes an air supply port which opens to said mixing chamber arranged such that axial and/or rotational movement of the valve body selectively varies the amount of air drawn into the mixing chamber in response to a reduced pressure created by said supplied water jet.

In accordance with another feature of a preferred embodiment, the valve body includes an adjustable tubular flow director having an inlet orifice communicating with said mixing chamber and a discharge orifice open to the tub water pool. A portion of the flow director exterior surface is spherical and cooperates with a lip adapted to seal against the spherical surface when the valve body is in its forward axial position. Axial movement of the valve body, achieved by rotating the control member, varies the spacing between the lip and the spherical surface which spacing defines the passageway for water entrainment.

In accordance with another feature of a preferred embodiment, the valve body includes multiple spaced fingers projecting axially to define a cage-like cavity. The fingers exhibit a slight degree of resilience in a radial direction to permit the flow director to be inserted into, and retained in, said cavity. The fingers bear against the flow director spherical surface to retain it in position while permitting the flow director to be manually swiveled within the cavity to allow the user to selectively direct the discharge stream.

In accordance with a further feature of a preferred embodiment, rotation of said valve body also selectively varies the magnitude of the water jet supplied to the mixing chamber and the momentum of the stream discharged from the jet assembly.

In accordance with a still further feature of a preferred embodiment, the geometry of the valve body, housing ports, and sealing lip is configured to permit the assembly to selectively operate in either the air entrainment mode or water entrainment mode, dependent on the rotational orientation of the control member. In accordance with a more specific feature, the discharge stream intensity (or momentum) is varied by rotating the control member to thus vary the effective size of the air entrainment passageway when in the air entrainment mode, the water entrainment passageway when in the water entrainment mode, and the water supply passageway in either mode.

In accordance with a still further feature, a cooperating cam and cam follower is used between the valve body and housing to achieve controlled nonlinear axial movement of the valve body in response to control member rotation.

DETAILED DESCRIPTION

Figure 1A:
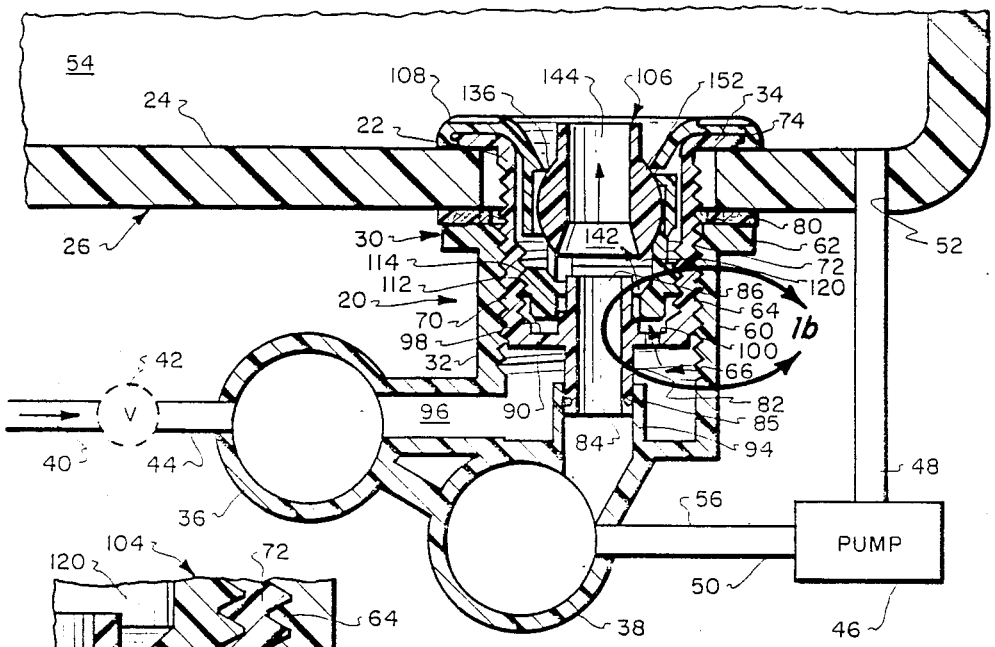
FIG. 1*a* is a sectional view of a first embodiment of a hydrotherapy jet assembly in accordance with the present invention showing the water entrainment path closed and air entrainment path open.
Figure 1B:
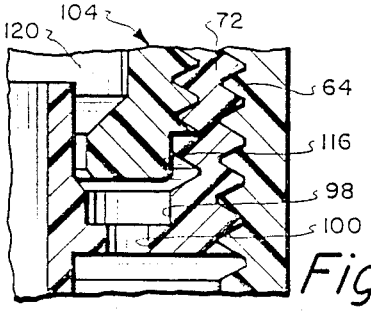
FIG. 1*b* is an enlarged sectional view of the area "1*b*" shown in FIG. 1*a;*
Figure 2:
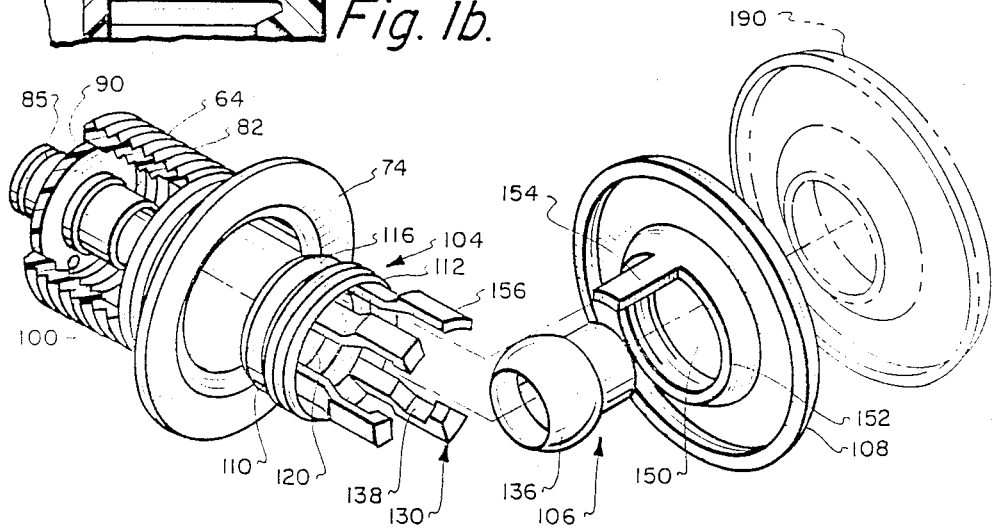
FIG. 2 is an isometric exploded view of the embodiment of FIG. 1*a;*
Figure 3:
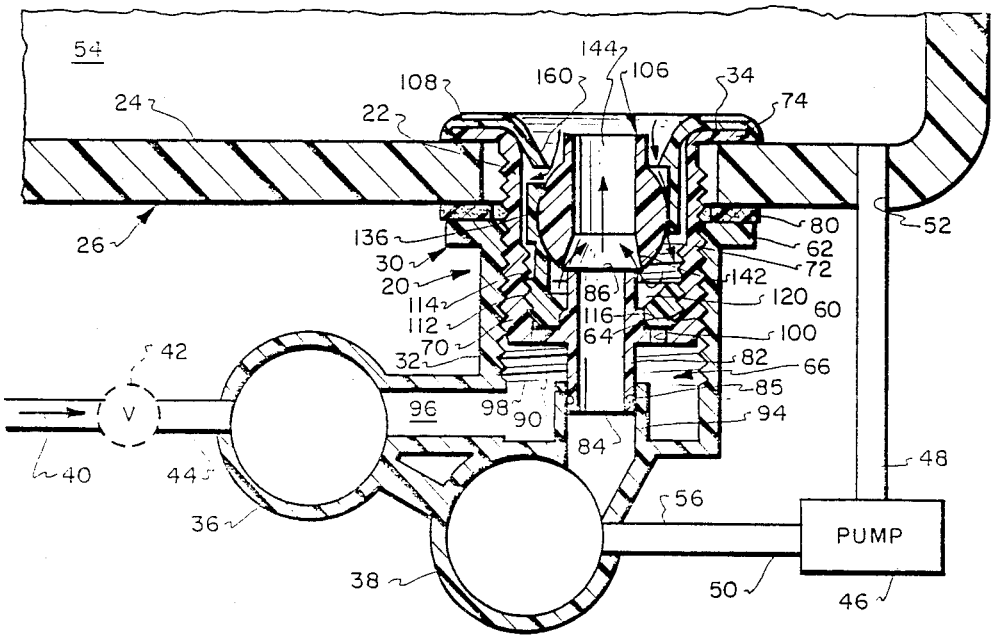
FIG. 3 is a sectional view of the embodiment depicted in FIG. 1*a*, however, showing the air entrainment path closed and water entrainment path open.

This application discloses four hydrotherapy jet assembly embodiments, all capable of operating in an air entrainment mode and a water entrainment mode. In the air entrainment mode, the user is able to vary the amount of air entrained by a supplied water jet to thus vary the intensity of the discharge stream. In the water entrainment mode, the user is able to vary the amount of tub water entrained by the supplied water jet to thus vary the intensity of the discharge stream. The first embodiment is depicted in FIGS. 1–3, the second embodiment in FIGS. 4–7, the third embodiment in FIGS. 8–14, and the fourth embodiment in FIGS. 15–18. The third and fourth embodiments permit the user to additionally vary the magnitude of the supplied water jet to vary the intensity of the discharge stream.

First Embodiment

Attention is initially directed to FIGS. 1*a*, 1*b*, 2, and 3 which depict a hydrotherapy jet assembly 20 intended to be mounted in an opening 22 in the peripheral wall 24 of a water tub 26.

The assembly includes a housing 30 formed primarily by a an aerator body 32 and a wall fitting 34. The aerator body 32 includes an air supply coupling 36 and water supply coupling 38. FIG. 1*a* schematically illustrates an available air source, represented by arrow 40, for supplying air to the coupling 36 via an optional external valve 42 via a pipe 44. It should be understood that the pipe 44 is only schematically represented in the Figures and that in an actual installation, the coupling 36 would be connected in conventional fashion to an air manifold pipe having a diameter substantially equal to that of coupling 36. FIG. 1*a* also schematically illustrates an electrically driven pump 46 for supplying pressurized water to coupling 36. The pump inlet side 48 is connected through an opening 52 in the tub wall 24 below the anticipated level of a water pool 54 in the tub. Thus, the pump 46 can draw water from the pool and supply it via pipe 56 to the water coupling 38. Again, it should be recognized that pipe 56 is schematically depicted and in an actual installation, the coupling 38 would be connected in accordance with conventional plumbing practice to a water supply manifold pipe having a diameter substantially equal to that of coupling 38. It should also be noted that although only a single jet assembly 20 is depicted in FIG. 1*a*, in an actual installation, it would be typical to mount several assemblies 20 at different locations in the wall 24 with the multiple assemblies all being connected to common air supply and water supply manifold pipes.

The aerator body 32 is comprised of a cylindrical section 60 having an outwardly extending terminal flange 62. The section 60 is hollow and has a threaded internal wall surface 64 surrounding a cavity 66.

The wall fitting 34 is formed by a substantially cylindrical wall 70 externally threaded at 72 for threaded mating with the wall surface 64 of aerator body 32. The wall fitting 34 also has an outwardly extending terminal flange 74. As depicted in FIG. 1*a*, the assembly 20 is mounted on the tub wall 24 by inserting the fitting 34 through opening 22 in wall 24 and then threading the fitting 34 into the aerator body 32. In this manner, the wall 24 is sandwiched between the wall fitting flange 74 and aerator body flange 62, preferably sealing material 80 is provided between the flange 62 and wall 24 to prevent leakage.

A nozzle 82, having an inlet end 84 and an outlet end 86, is centrally formed on rear wall 90 of the wall fitting 34. The inlet end 84 extends into an open boss 94 communicating with the interior of the water coupling 38.

The air coupling 36 communicates via channel 96 with the aforementioned interior cavity 66. An air hole 100 extends through the wall 90 to an annular recess 100 formed on the interior surface of wall 90.

As previously discussed, the essential function of assembly 20 is to discharge a high momentum water stream into the tub 26 beneath the surface of the water pool 54 for creating turbulence and impacting against a user's body. More specifically, the assembly 20 is intended to enable a user to control the discharged water stream so that it selectively includes a variable entrained amount of either air or tub water. In order to provide the user with this control capability, assembly 20 further includes a specially constructed valve body 104, a tubular flow director or eyeball 106, and a manually controllable member or ring 108. Briefly, the elements 104, 106, and 108 are mounted forward of the outlet end 86 of nozzle 82 to pass a water jet supplied by the nozzle. As will be seen hereinafter, depending upon the adjustable axial and rotational orientation of the valve body 104, the water jet supplied by the nozzle 82 will entrain variable amounts of air and/or tub water prior to being discharged into the tub pool.

The valve body 104 comprises a short essentially tubular cylindrical section 110 having external threads 112. The valve body external threads are adapted to engage the threaded inner wall 114 of wall fitting 34. The rear portion of the valve body is shaped, as is best shown in FIG. 1*b*, to be closely received within the annular recess 101. When the valve body 104 is in its forward axial position, as depicted in FIGS. 1*a* and 1*b*, air hole permits air flow from channel 96 through cavity 66 past valve body portion 116 into a mixing chamber area 120. On the other hand, when the valve body 104 is moved to its rearward axial position, as depicted in FIG. 3, then the valve body portion 116 moves into recess 101 to seal air hole 100.

Three spaced fingers 130 project axially forward from the valve body tubular section 110. The fingers 130 are preferably formed integral with the section 110 and are circumferentially spaced from one another by approximately 120° to define a cage like cavity 134 into which the spherical portion 136 of the thrust director 106 can be received and retained. The valve body 104 is preferably formed of a plastic material which permits the fingers 130 to exhibit slight radial resiliency and at least one of the fingers is undercut, as at 138, to allow the spherical portion 136 to be readily manually inserted and removed from the cage like cavity 134. When the spherical portion 136 is placed within the cavity, the fingers 130 will bear against its exterior surface to hold its orientation while permitting it to be manually swiveled relative to the valve body 104 to selectively direct the discharge stream.

The thrust director 106 defines an interior flow path having an inlet orifice 142 and a discharge orifice 144. In assembling the assembly 20, the thrust director 106 is inserted into the cage like cavity 134 and then the valve body 104 is manually threaded into the wall fitting 34. Thereafter, the control member 108 is snapped over the flange 74 of the wall fitting as is depicted in FIG. 1*a*. The member 108 comprises a ring having a central opening 150 defined by an axially depressed circular lip 152. An axially extending finger 154 extends rearwardly from the lip 152 and fits between one of the fingers 130 and an extra finger 156 formed on the valve body 104 and spaced close to one of the fingers 130. The slot formed between the extra finger 156 and its neighboring finger 130 accommodates the finger 154 extending from control member 108. Thus, by the user manually rotating the member 108, the valve body 104 is rotated relative to the wall fitting 34 causing it to move axially relative to the wall fitting.

Now considering further the details of member 108, note that when the valve body 32 is in its forwardmost axial position depicted in FIG. 1*a*, the circumferential lip 152 seals against the spherical surface of thrust director 106. Moreover, in this axial In contrast, when the ring 108 is rotated to move the valve body 104 to its rearmost axial position as depicted in FIG. 3, then the thrust director 106 moves axially away from the sealing lip 152 and additionally the valve body portion 116 moves into recess 98 to seal the air hole 100.

In the use of jet assembly 20 of FIGS. 1–3, high pressure water is supplied by electrically driven pump 46 to coupling 38 and then through nozzle 82 which in turn supplies a high pressure water jet to the inlet orifice 142 of flow director 106. The enclosed volume outside of the outlet end of nozzle 82 and including the entrance to the tubular member 106 forms the aforementioned mixing chamber generally depicted as 120. By well known jet pump action, the supplied water jet acts to reduce the pressure within the mixing chamber 120 enabling, selectively, air to be drawn into the mixing chamber via air hole 100 or tub water to be drawn into the mixing chamber along a passageway from the water pool past the sealing lip 152 and between the spaced fingers 130. That is, when the valve body 104 is in the axial position depicted in FIG. 1*a*, the passageway from the tub water pool into the mixing chamber 120 is closed by the sealing lip 152 engaging the spherical surface of the thrust director 106. In this axial position, however, the air hole 100 is open and the water jet discharged into the mixing chamber 120 entrains air drawn from the coupling 36 via channel 96. On the other hand, when the valve body 104 is moved to the axial position depicted in FIG. 3, the air hole 100 is sealed and tub water flow is permitted past the sealing lip 152 exteriorly of the thrust director 106, between the fingers into the mixing chamber 120.

The following Table I generally describes the operation and performance of a jet assembly constructed in accordance with the embodiment of FIGS. 1–3. In this embodiment, the control member 108 is mounted for rotation, defined by mechanical stops 164, 166, through a range of 328°. FIGS. 1*a* and 3 respectively depict the axial position of the valve body 104 at rotational positions of 0° and 328°.

TABLE I

| | ROTATION ANGLE | WATER ENTRAIN. | WATER SUPPLY | AIR ENTRAIN. | DISCHARGE MOMENTUM |
|---|---|---|---|---|---|
| AIR ENTRAINMENT MODE | 0° (STOP) | CLOSED | OPEN | OPEN | +4 |
| | 80° | NEGLIG. | OPEN | VAR. | +3.5 |
| | 165° | VAR. | OPEN | | +3 |
| WATER ENTRAINMENT MODE | 248° | | OPEN | NEGLIG. | +3.5 |
| | 328° (STOP) | OPEN | OPEN | CLOSED | +4 |

Note that for a 0° rotation, the water entrainment path, i.e. the tub water passageway past sealing lip 152, is closed and the air entrainment path through hole 100 is open. This position results in substantially conventional air entrainment operation producing a high momentum stream at the discharge orifice 144. To facilitate explanation herein, an arbitrary scale of NEGLIGIBLE to +4 has been used to represent the magnitude of the discharge stream momentum. Thus, for the 0° position represented in Table I, with full air entrainment, the discharge stream is shown as having a momentum of +4. As the control member 108 is rotated toward 328°, note that the air entrainment passageway through hole 100 will gradually close as the water entrainment passageway past sealing lip 152 will gradually open. From 0° to approximately 165°, as the air entrainment passageway closes, the momentum of the discharge stream diminishes from approximately +4 to +3. Thereafter, as the air entrainment passageway is reduced to NEGLIGIBLE and then CLOSED, while concurrently the water entrainment passageway opens, the momentum of the discharge stream increases back toward +4.

Thus, by manually rotating the control member 108, the user is able to selectively vary the amount of air entrainment or water entrainment desired and the impacting momentum of the discharge stream. Whereas some users may prefer the air entrainment mode, because of the presence of air bubbles, other users are likely to prefer the water entrainment mode because it reduces the necessity of heater intervention and/or hot water replacement, and the operating noise level.

A jet assembly 20 in accordance with the invention would find application in any water tub application, e.g. spa, hot tub, jetted bathtub, etc. The assembly can be manufactured very inexpensively of injection molded plastic parts and indeed the only parts visible to the user, i.e. the eyeball 106 and plate 108, can be manufactured in various colors to compliment the colors of the tub walls 26. Additionally, a trim ring 190 can be provided (which can be used with each disclosed embodiment), formed for example of brass or chrome plated metal, for attachment over the control ring 108 to matching other bathroom fixtures.

Second Embodiment

Attention is now called to FIGS. 4–7 which depict a jet assembly 200 very similar to the aforediscussed assembly 20 except that an improved air valve arrangement has been incorporated to afford the user greater control of the discharge stream in the air entrainment mode. That is, recall from FIGS. 1–3 that the closing of the air passageway was effected by the axial movement of the valve body 104 which was solely attributable to the threading of the valve body 104 in the wall fitting 34. In order to achieve more rapid and positive closing of the air passageway, assembly 200 utilizes a valve element 202 which is loosely mounted for linear movement in an air hole 203. The valve element 202 includes a cylindrical cap 204 and a cylindrical body 206 supporting an O-ring 207 therebetween. A fluted lower portion comprised of four legs 208 arranged in cruciform fashion in cross section depends from cylindrical body 206.

Assembly 200 further includes a valve body 220 whose lower portion includes a cam surface 222. The cam surface 222 is intended to engage the cap 204 to establish the position of the valve element 202 within the air hole 203. Table II depicts the operation of the assembly 200 depicted in FIGS. 4–7.

TABLE II

| | ROTATION ANGLE | WATER ENTRAIN. | WATER SUPPLY | AIR ENTRAIN. | DISCHARGE MOMENTUM |
|---|---|---|---|---|---|
| AIR ENTRAINMENT MODE | 0° (STOP) | CLOSED | OPEN | OPEN | +4 |
| | | | | VAR. | |
| | 80° | NEGLIG. | OPEN | NEGLIG. | +2 |
| | 165° | | OPEN | CLOSED | +2.75 |
| | | VAR. | | | |
| WATER ENTRAINMENT MODE | 248° | | OPEN | CLOSED | +3.5 |
| | 328° (STOP) | OPEN | OPEN | CLOSED | +4 |

Figure 4:
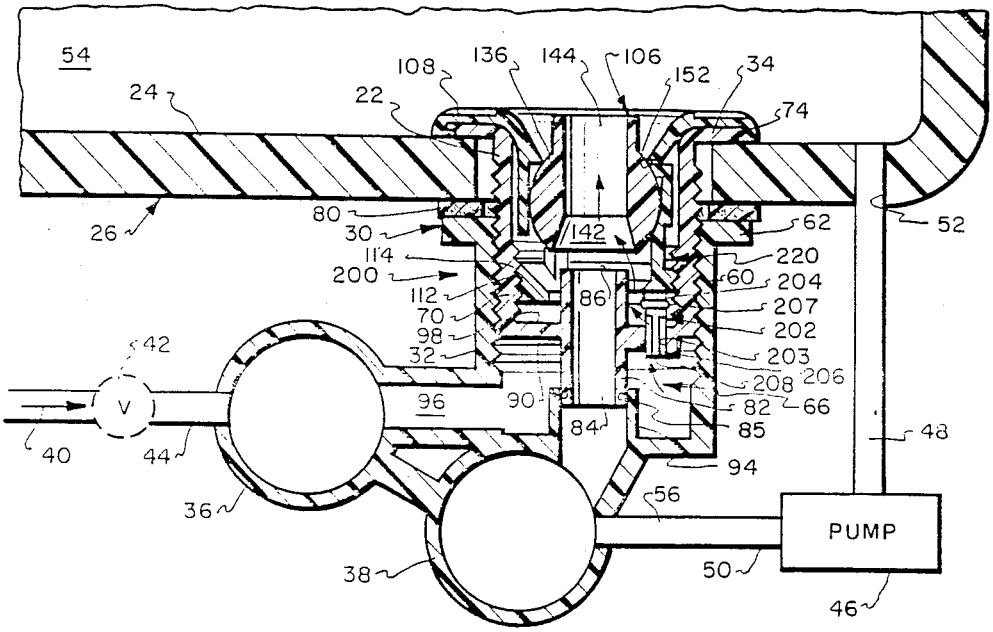
FIG. 4 is a sectional view of a second embodiment of the present invention showing the air entrainment path open and water entrainment path closed.
Figure 5:
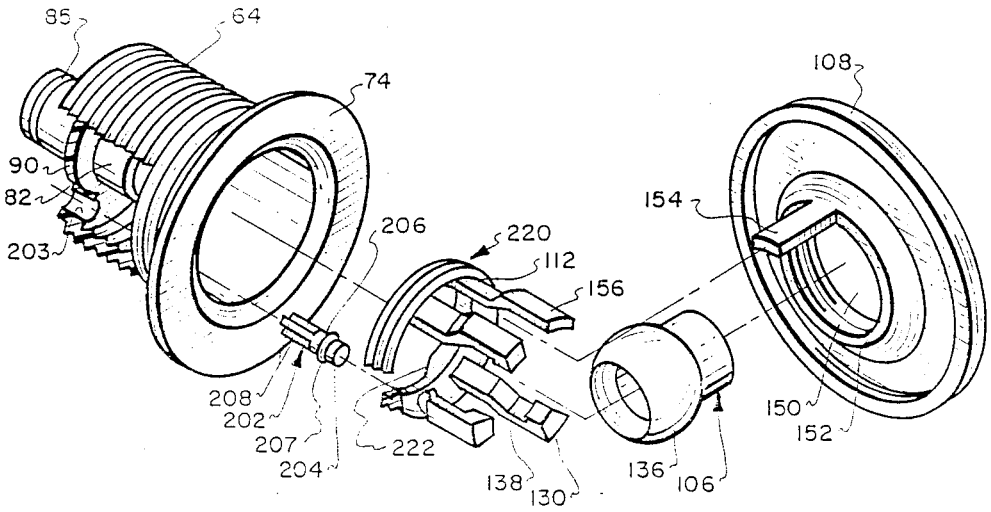
FIG. 5 is an exploded isometric view of the second embodiment depicted in FIG. 4.
Figure 6:
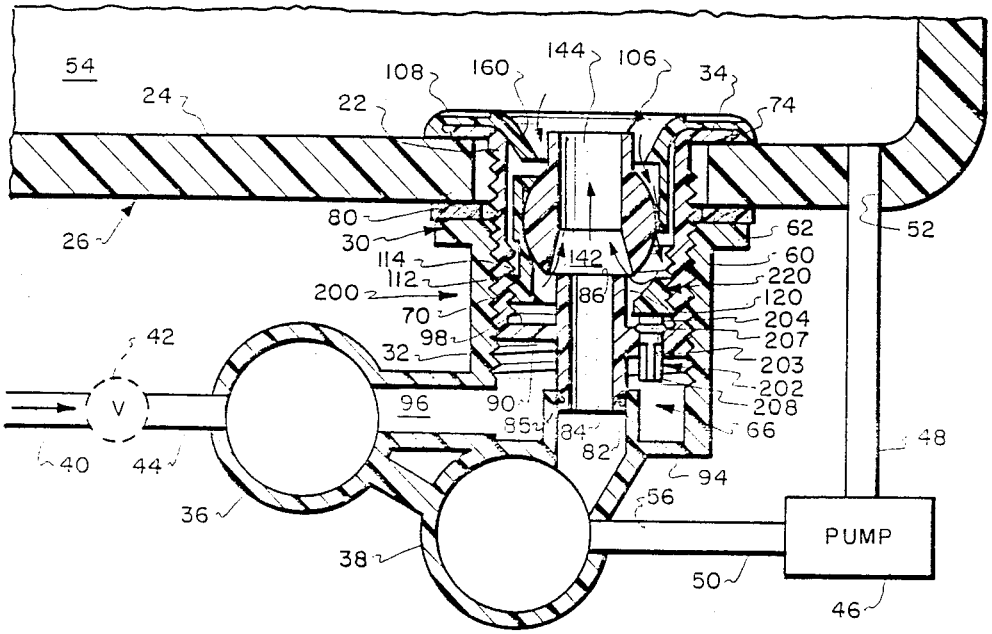
FIG. 6 is a sectional view of the embodiment depicted in FIG. 4 except showing the air entrainment path closed and the water entrainment path open.
Figure 7A:
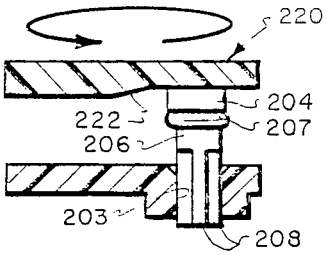
FIGS. 7*a*, 7*b*, and 7*c* are enlarged sectional views of the embodiment depicted in FIGS. 4–6 showing particularly the relationship between the air valve element and the cam surface formed on the valve body.
Figure 7B:
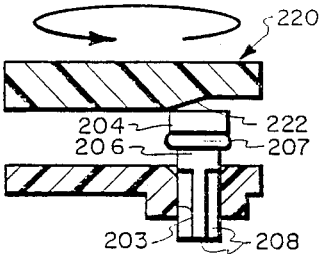
Figure 7C:
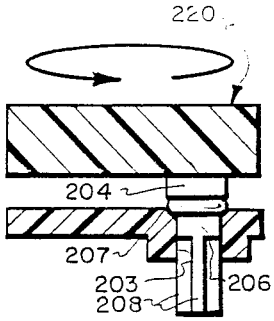
Figure 10:
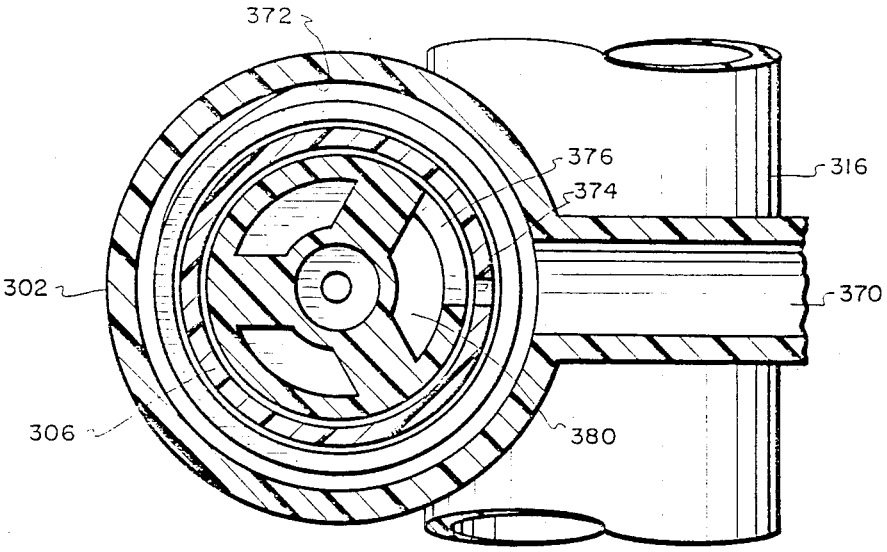
FIGS. 10 and 11 are sectional views respectively taken along the planes 10—10 and 11—11 of FIG. 9.

FIGS. 4 and 6 respectively depict the axial position of the valve body at rotational positions of the control member at 0° and 328°.

At 0°, as represented in FIG. 4, the air entrainment passage will open as the reduced pressure in the mixing chamber draws air from air coupling 36 to force the valve element 202 open permitting air to flow between the valve element legs 208 into the mixing chamber 120 for entrainment by the water jet supplied by nozzle 82. FIGS. 4 and *7a* show the relationship between the cam surface 222 and valve element 202 at 0°, i.e. with the air passageway fully open. As the control member is rotated, the cam surface 222 will move the valve element 202 to an intermediate position, (approximately 80° as represented shown in FIG. *7b*) at which the body 206 substantially closes the air hole 203. FIGS. 6 and *7c* show the O-ring 207 to fully close the air passageway at 318°.

Because of the use of the cam surface 222, the air hole 203 can be closed within a shorter range of axial movement of the valve body and a smaller rotation of the manual control member. Thus, note in Table II that the air entrainment passageway is variable between 0° and 80° substantially closing before the water entrainment passageway opens significantly. Thus, in the embodiment of FIGS. 4–6, because at 80°, both the air entrainment and water entrainment passageways are only negligibly open, a lower discharge stream momentum can be achieved than in the first embodiment. In other words, by rotating the control member from only 0° to 80°, the discharge momentum is reduced from +4 to +2. Then by further rotating the control member from 80° to 328°, the water entrainment passageway gradually opens to increase the discharge stream momentum to +4.

Third Embodiment

Attention is now directed to FIGS. 8–14 which illustrate the construction and operation of a third jet assembly embodiment 300 in accordance with the present invention. The embodiment 300 provides operational advantages over the two previously discussed embodiments, which advantages should become apparent from the following Table III:

TABLE III

| | ROTATION ANGLE | WATER ENTRAIN. | WATER SUPPLY | AIR ENTRAIN. | DISCHARGE MOMENTUM |
|---|---|---|---|---|---|
| AIR ENTRAINMENT MODE | 0° (STOP) | CLOSED | OPEN VAR. | OPEN VAR. | +4 VAR. |
| | 75° | SMALL | SMALL | CLOSED | +1 |
| | 85° | SMALL | NEGLIG. | CLOSED | NEGLIG. |
| WATER ENTRAINMENT MODE | 95° | SMALL VAR. | NEGLIG. VAR. | CLOSED | NEGLIG. VAR. |
| | 180° (STOP) | OPEN | OPEN | CLOSED | +4 |

Initially, note in Table III that the total rotational range for the control member has, for convenience, been restricted to 0°–180°. Additionally, note that whereas the water supply path in the first two embodiments was always open, the embodiment of Table III provides for varying the water supply path while concurrently varying the water entrainment and/or air entrainment paths. This feature enables the user to more significantly vary the momentum of the discharge stream as shown in Table III. With reference to the same arbitrary scale of NEGLIGIBLE to +4 previously assumed in Tables I and II, note in Table III that the third embodiment, i.e. assembly 300, can discharge a stream whose momentum, in the air entrainment mode, can be varied from +4 down to +1 and then in the water entrainment mode can be varied from an essentially negligible level up to +4. Thus it should be appreciated that the third embodiment of the invention provides a user with a broader range of discharge stream momentum which can be more easily selected within a narrower range of rotation of the control member.

Assembly 300 is similar to the two aforediscussed assemblies in that it includes an aerator body 302 having a flange 304 and a wall fitting 306 having a flange 308. The outer surface of the wall fitting 306 is threaded into an internal surface of the aerator body 302 to sandwich a tub wall 310 between the flanges 304 and 308. Gasket material 312 is preferably provided between the wall 310 and flange 304 to prevent water leakage. The aerator body 302 includes an air supply coupling 314 and water supply coupling 316.

Figure 9:
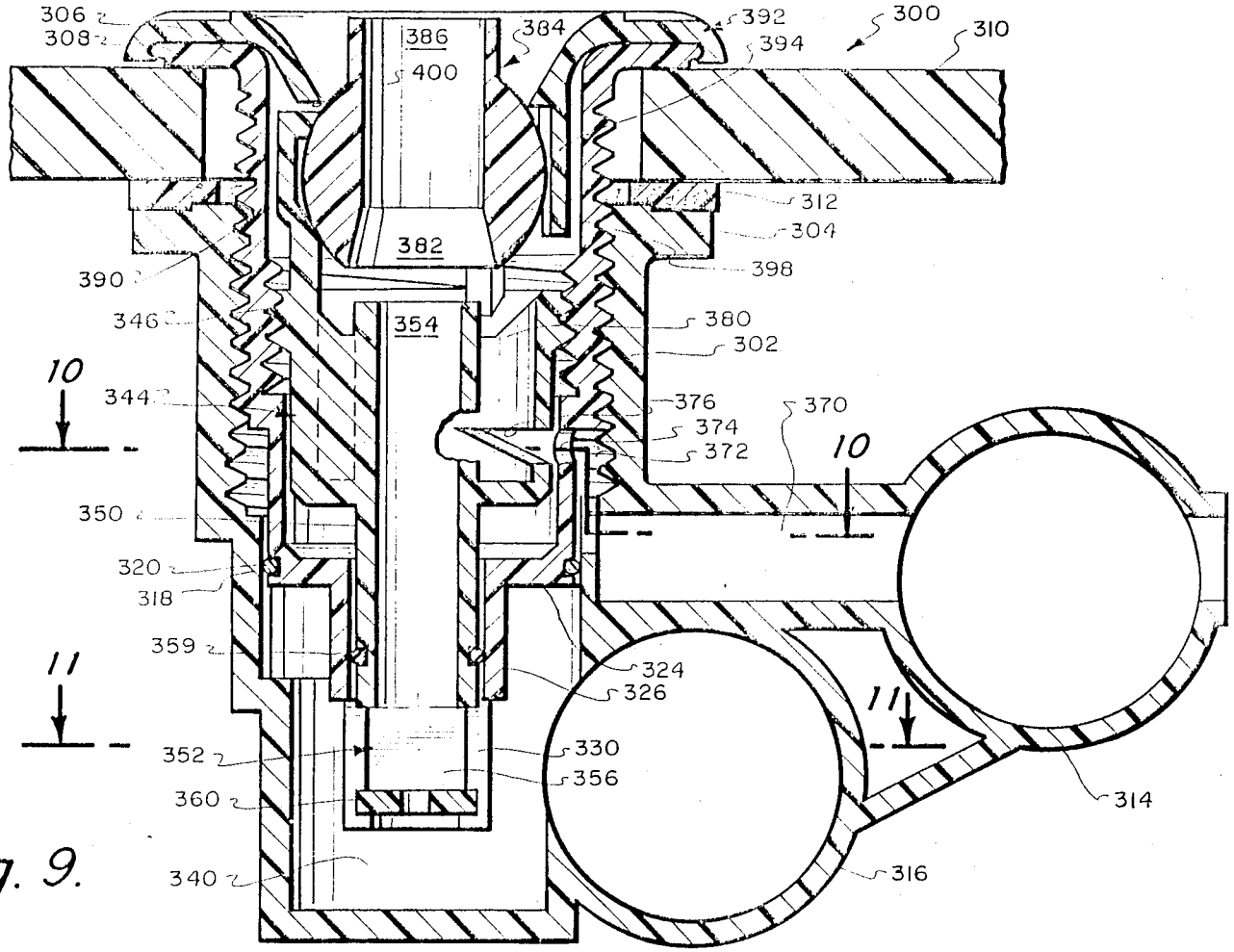
FIG. 9 is a sectional view of the third embodiment showing the air entrainment path open and water entrainment path closed.
Figure 12:
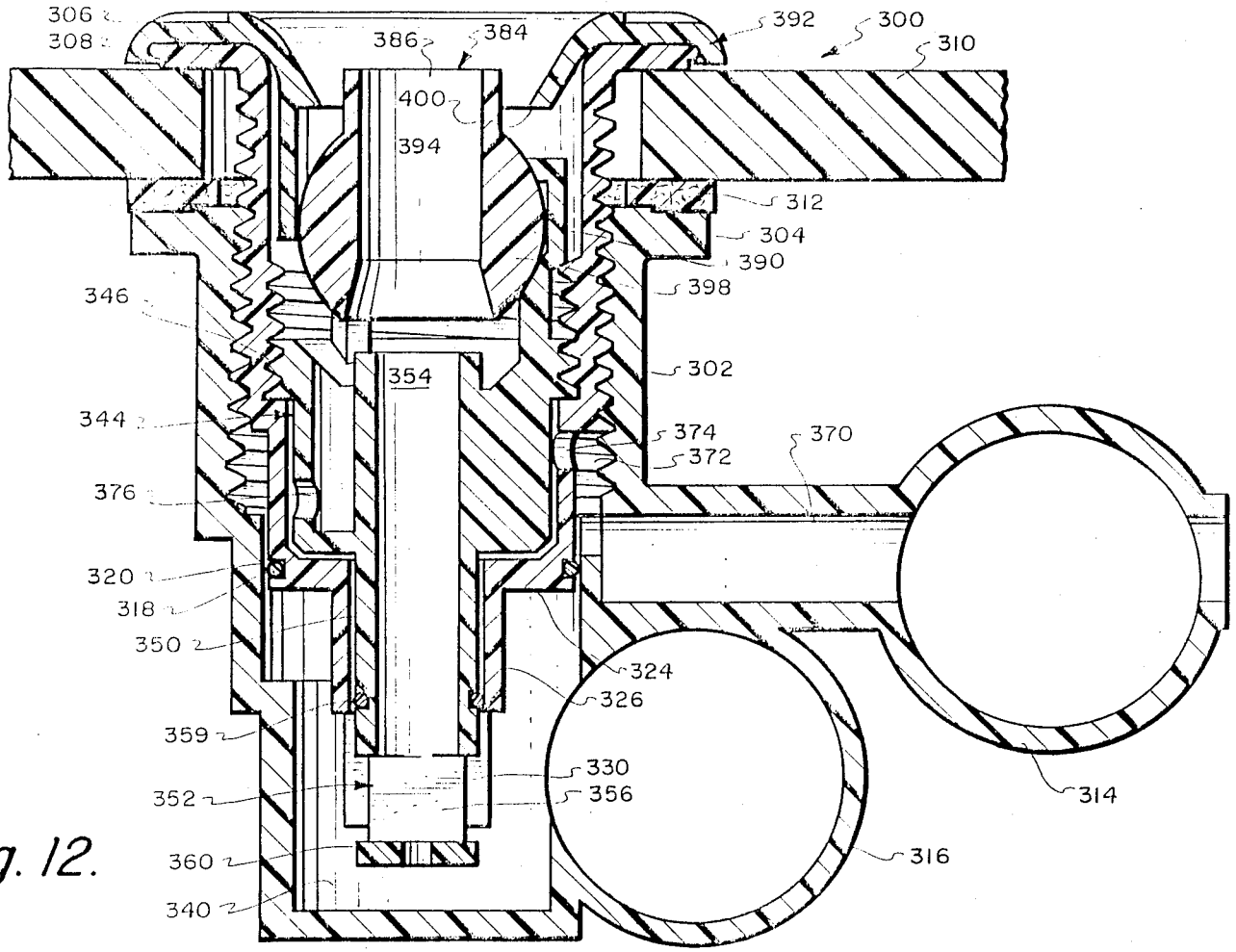
FIG. 12 is a sectional view of the third embodiment similar to that depicted in FIG. 9, except showing the air entrainment path closed and water entrainment path open.

The wall fitting 306 is substantially cylindrical and is threaded into the body 302 as shown in FIG. 9. The fitting 306 includes a recess 318 which accommodates an O-ring 320 to seal against the interior wall of body 302. The lower end of wall fitting 306 as viewed in FIG. 9, includes a bottom wall 324 provided with an open centrally located cylindrical nipple 326. The rear end of the nipple 326 is cut away to leave two arcuate side walls 330, 332 which are best depicted in the sectional view of FIG. 11. The side walls 330 and 332 are thus spaced by openings 334 and 336 openings 334 and 336 communicate with a cavity 340 internal to the aerator body 302. Water supply coupling 316 opens into the cavity 340.

Figure 11:
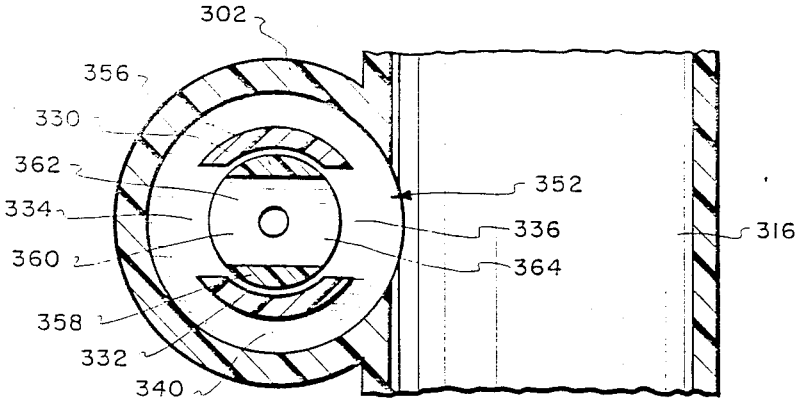
Figure 8:
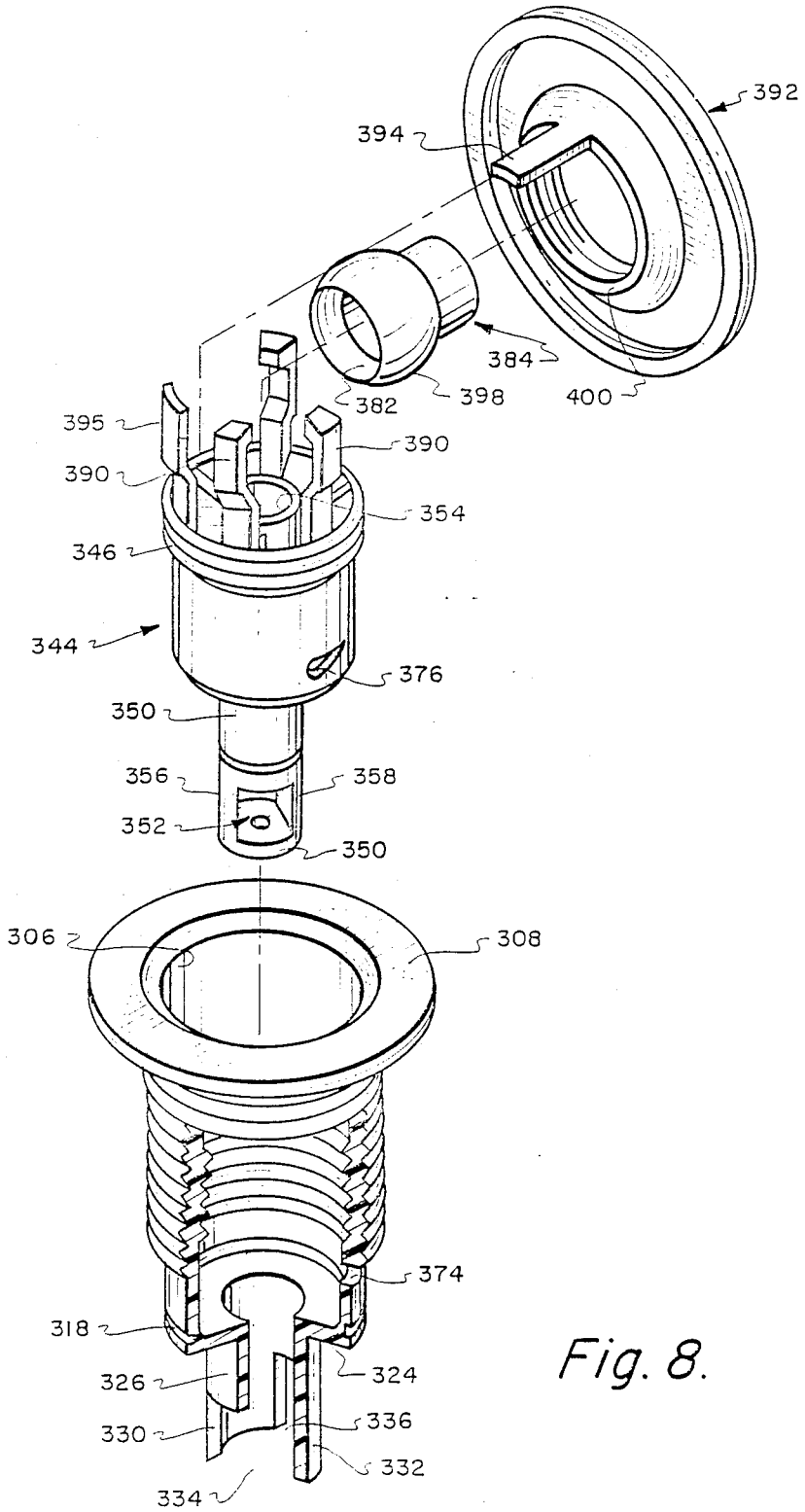
FIG. 8 is an exploded isometric view of a third embodiment of the present invention.

Assembly 300 also includes a valve body 344 substantially cylindrical in cross section. The exterior surface 346 of the valve body is threaded into the interior wall surface of wall fitting 306. The valve body 344 is formed to define an open cylindrical nozzle 350 having an inlet end 352 and an outlet end 354. The inlet end of the nozzle is cut away to define two short arcuate side wall portions 356 and 358 which are best shown in FIG. 11. The side wall sections 356 and 358 are bridged by a wall 360. The nozzle 350 fits for concentric rotation in nipple 326. O-ring 359 prevents leakage between the nozzle outer wall and nipple. Together, the side wall sections 356, 358, and end wall 360 define openings 362 and 364 which can align with the openings 334 and 336 defined by the wall fitting 306. However, by rotating the valve body 344 relative to the wall fitting 306, the side wall sections 356 and 358 of the valve body 344 will move relative to the wall fitting to block the openings 334 and 336. This will be discussed in greater detail hereinafter in connection with the schematic diagram of FIG. 13.

The air supply coupling 314 opens through channel 370 and passage 372 to an opening 376 in wall fitting 306. This can perhaps best be seen in FIG. 9. Opening 376 communicates with a mixing chamber 380 proximate to the outlet end 354 of the nozzle 350 and adjacent to the inlet orifice 382 of flow director 384. An internal passageway extends from inlet orifice 382 to discharge orifice 386.

The tubular flow director 384 is mounted within a cage-like cavity defined by fingers 390 projecting axially from the valve body 344 in the same manner as was discussed in connection with the embodiment of FIGS. 1–3. Similarly, a manually rotatable control member 392 is provided having a depending finger 394 which fits between finger 390 and extra finger 395 to enable rotation of the valve body 344. Rotation of the control member 392 produces both rotational and axial movement of the valve body 344. In the assembly 300 axial movement of the valve body 344 selectively varies the water entrainment passageway defined between the spherical surface 398 of the flow director 384 and a sealing lip 400 defined by the control member 392, in the same manner as has been previously discussed. Further, in assembly 300, the rotational position of the valve body 344 varies the air flow passageway dependent upon the degree of mating between fixed air hole 374 and the tear drop shaped air hole 376 on valve body 344. Additionally, the rotational position of the valve body 344 determines the amount of high pressure water supplied from coupling 316 into the inlet end of nozzle 352, depending on the alignment between openings 362, 364 and 334, 336.

In order to better understand the operation of the assembly 300 to produce the operational characteristics described by Table III, attention is directed to FIG. 13 which schematically depicts the water entrainment path, the air entrainment path, and the water supply path for each of the rotational positions shown in Table III. Initially consider a 0° rotation, as represented in FIG. 9. As shown schematically in FIG. 13*a*, in this position the water entrainment path is closed because the spherical surface 398 of the flow director 384 is sealed against the lip 400 of control member 392. With the same 0° rotation depicted in FIG. 13*a*, the air hole 376 formed on the wall of valve body 344 will be aligned with the air hole 374 on wall fitting 306 and thus the air entrainment passageway will be fully open. With the same 0° rotation, the side wall sections 356 and 358 of the valve body 344 will be adjacent to the side wall sections 330 and 332 of wall fitting 306 and thus the water supply path will be fully open.

Figure 13A:
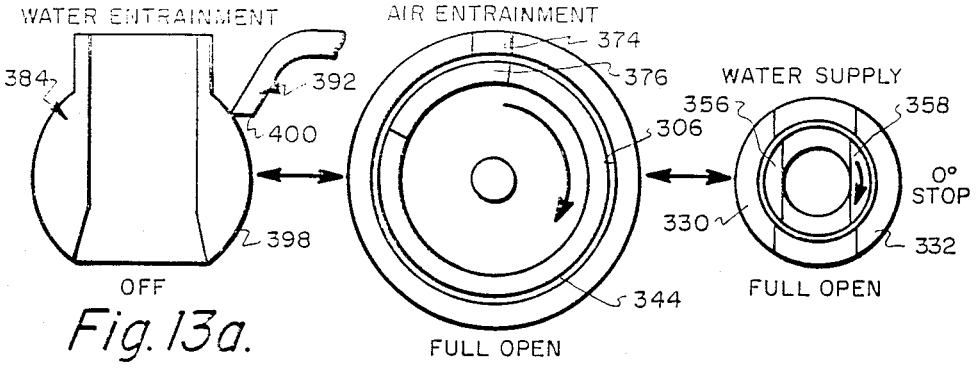
FIGS. 13*a*, 13*b*, 13*c*, 13*d*, and 13*e* are schematic representations showing the valve orientations for water entrainment, air entrainment, and water supply for various degrees of rotation of the control member of the third embodiment depicted in FIGS. 8–12.
Figure 13B:
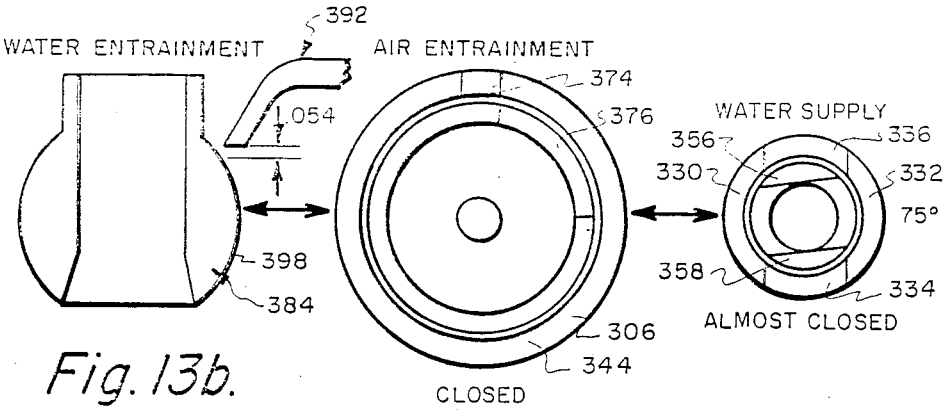
Figure 13C:
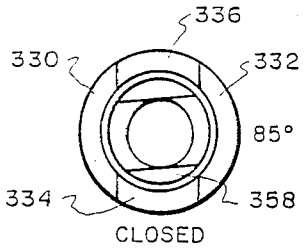

Now consider rotation of the control member by 175° as represented in FIG. 13*b*. Note that the water entrainment path is now slightly open as the flow director 384 has moved axially away from the sealing lip 400, the air entrainment path is closed as the air opening 376 has moved out of alignment with the air opening 374 and the water supply path opening has closed substantially. Thus, by rotating the control member 392 from 0° through 75° as represented by FIGS. 13*a* and 13*b*, and by corresponding entries in Table III, it should be apparent that the user will gradually reduce both the amount of water supplied and air entrainment to reduce the momentum of the discharge stream (i.e. +4 to +1).

At 85° (FIG. 13*c*) and at 95° (FIG. 13*d*) the water supply path becomes very small or negligible and consequently the momentum of the discharge stream is also negligible. In actual installations, it is preferable to prevent complete closure of the water supply path to avoid damaging the pump supplying water to the coupling 316. Rather, it is preferable that at least a negligible amount of water be permitted to flow into the nozzle 350 for all positions of the control member 392.

Figure 13D:
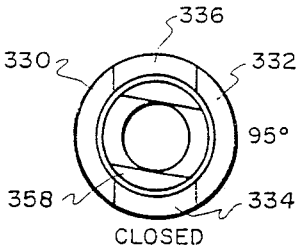
Figure 13E:
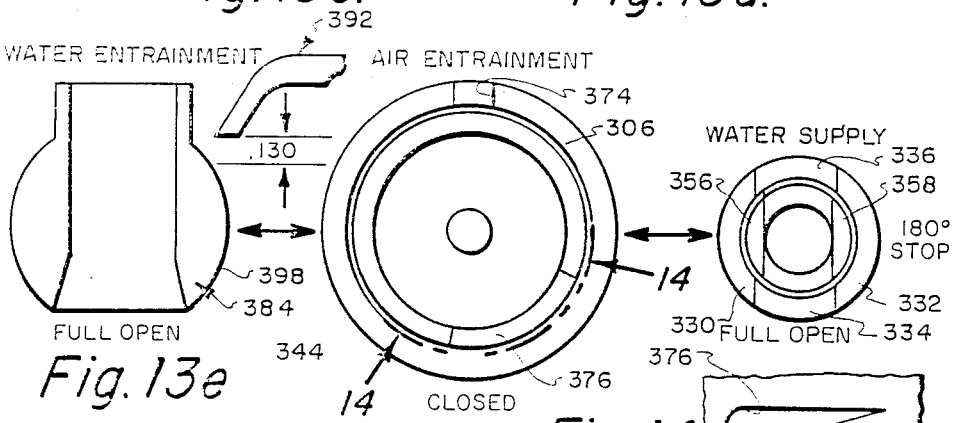
Figure 14:
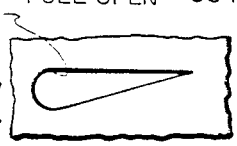
FIG. 14 is a developed plan view showing the shape and orientation of the air inlet port on the valve body of the embodiment of FIGS. 8–12.
Figure 15:
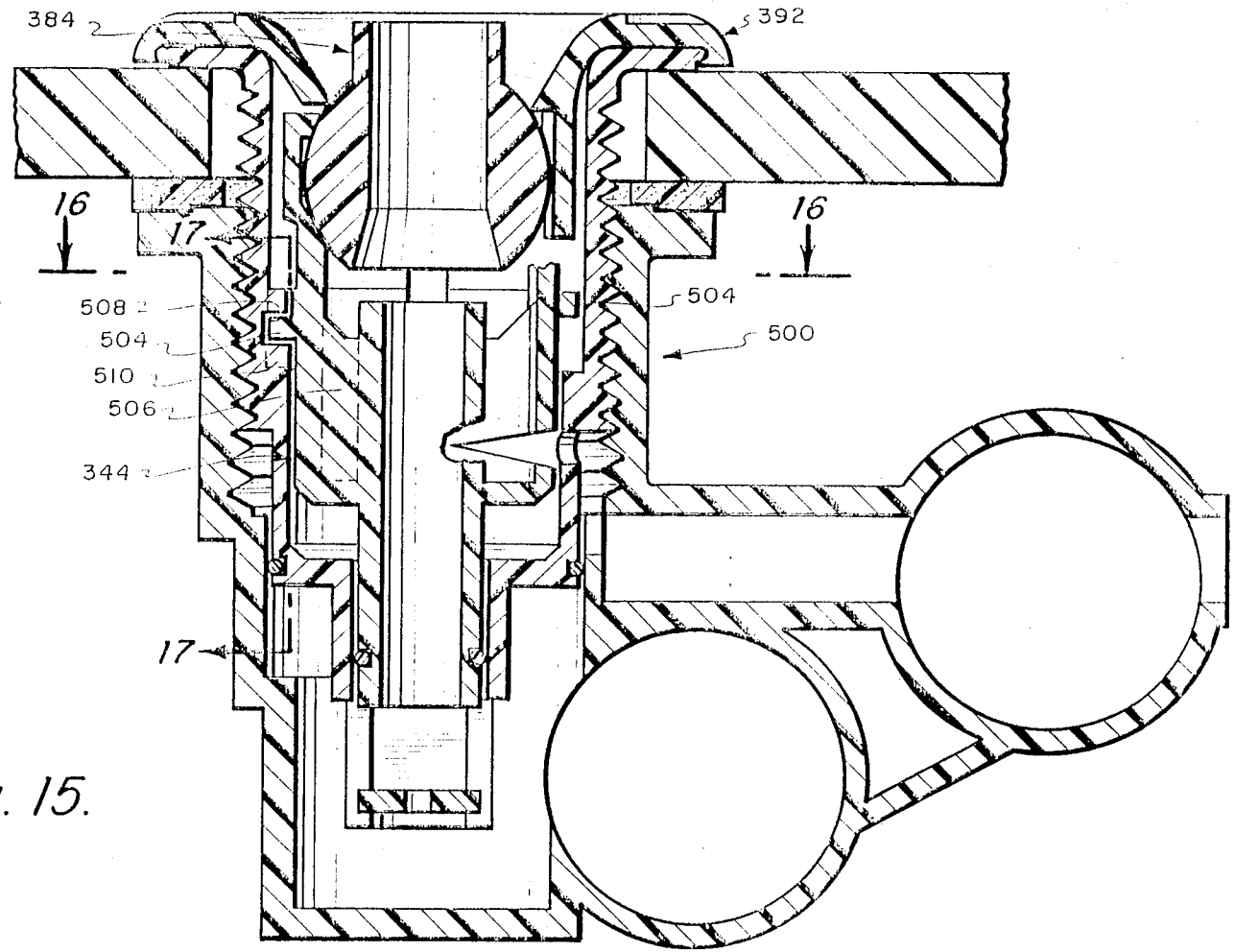
FIG. 15 is a sectional view of the fourth embodiment showing the air entrainment path open and water entrainment path closed.
Figure 16:
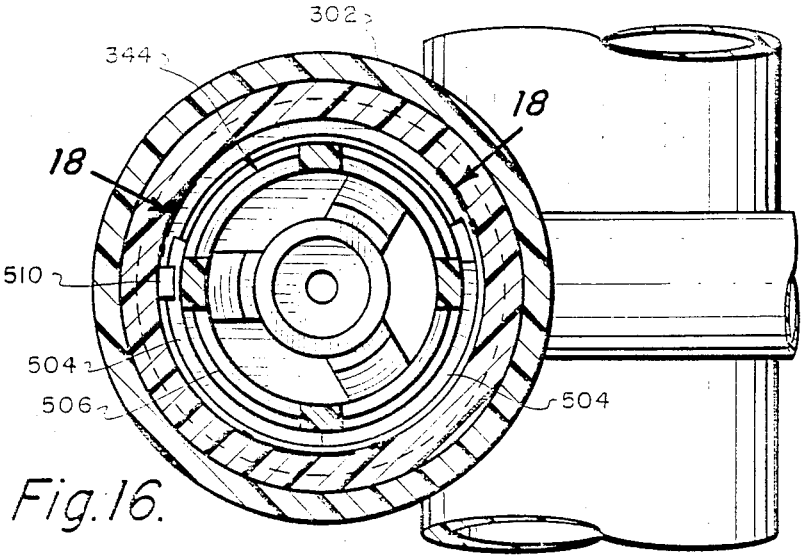
FIGS. 16 and 17 are sectional views respectively taken substantially along the planes 16—16 and 17—17 of FIG. 15.
Figure 17:
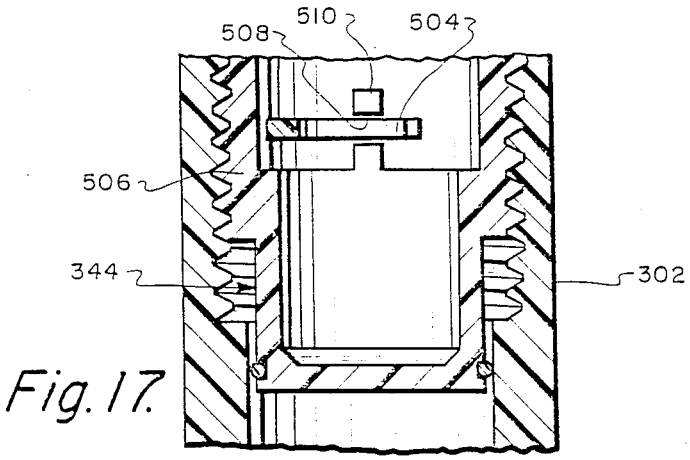
Figure 18:
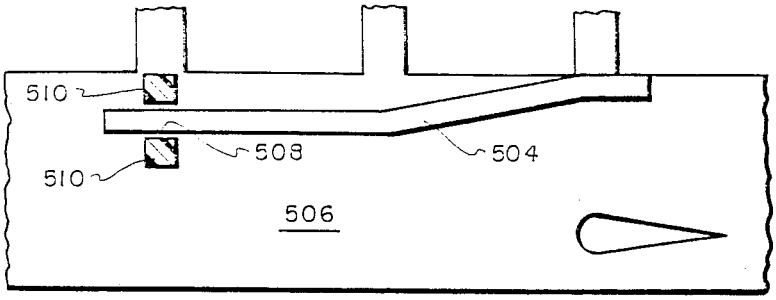
FIG. 18 is a developed sectional view of a portion of the valve body taken along 18—18 of FIG. 16 showing the cam surface.

Note in FIG. 13*d*, that further clockwise rotation of the control member will start to open the water supply passageway. The air entrainment passageway will remain closed but the water entrainment passageway between the flow director 384 and the sealing lip 400 will progressively open. Thus, between approximately 95° and 180°, as progressively more tub water is entrained by the increasing amount of water supplied from the nozzle 350, the momentum of the discharge stream will increase, shown in Table III to be from a negligible value to +4.

Thus, the assembly 300 enables the user to vary the momentum of the discharge stream over a wide range in both the air entrainment mode and the water entrainment mode with a rotational range of the control member of 180°. This degree of control is achieved in a very compact assembly which can be readily manufactured of inexpensive molded plastic parts.

From the foregoing description of the third embodiment depicted in FIGS. 8–14, it should be recognized that the water entrainment path attributable to the axial movement of the valve body 344 begins gradually opening well prior to the 95° position at which the water supply means begins to open for the water entrainment mode. More specifically, note for example in Table III and in FIG. 13*b* that, for a 75° rotation, the water entrainment path is open slightly so that with a small water supply flow, some degree of tub water entrainment occurs. Also, note that the water entrainment path continues to gradually open as the control member is rotated through 85° to 95° all while the water supply flow is negligible. This fact of course is attributable to the axial movement of the valve body 344 being linearly related to the rotational movement of the valve body. In other words, as a consequence of the threaded engagement between the valve body 344 and the wall fitting 306, a 1° rotational movement of the valve body will produce a fixed amount of axial movement. In order to even further enhance the user's ability to selectively vary the momentum of the discharge stream throughout both the air entrainment mode and water entrainment mode, attention is now directed to the fourth embodiment depicted in FIGS. 15–18.

Fourth Embodiment

Assembly 500 of FIG. 15–18 is substantially identical to embodiment 300 of FIGS. 8–14 except that in lieu of threadedly engaging the valve body 344 within the wall fitting 306, a cam and cam follower arrangement is used. More specifically, note that a ridge or key 504 is formed on the outer surface of the valve body 506. The key 504 projects radially and extends in excess of 180° around the circumference of the valve body 506. The key 504 extends through a keyway or slot 508 which projects radially outward in the interior wall of the wall fitting 510. The key 504 is shaped to define a cam surface to introduce a nonlinear relationship between the rotational movement of the valve body 506 and its axial movement. More specifically, in order to optimize the full range of available valve body axial movement for water entrainment path adjustment, it is desired that the water entrainment not begin to open until approximately 95°, as the water supply path begins to open. This operation is depicted by the following Table IV:

TABLE IV

| | ROTATION ANGLE | WATER ENTRAIN. | WATER SUPPLY | AIR ENTRAIN. | DISCHARGE MOMENTUM |
|---|---|---|---|---|---|
| AIR ENTRAINMENT MODE | 0° (STOP) | CLOSED | OPEN VAR. | OPEN VAR. | +4 VAR. |
| | 75° | CLOSED | SMALL | CLOSED | +½ |
| | 85° | CLOSED | NEGLIG. | CLOSED | NEGLIG. |
| WATER ENTRAINMENT MODE | 95° | NEGLIG. VAR. | NEGLIG. VAR. | CLOSED | NEGLIG. VAR. |
| | 180° (STOP) | OPEN | OPEN | CLOSED | +4 |

In order to prevent the water entrainment path from opening between approximately 0° and 90°, the key 504 is shaped so that it is flat, i.e. has no axial pitch, for the initial approximately 90° around the valve body 506. Thus, for rotation of the control member from 0° to approximately 90°, the key 504 will move through the keyway 508 without the keyway wall exerting any axial force on the key. However, from about 95° to 180°, the shape of the key 504 is angled so as to have an axial pitch component. Accordingly, as the valve body 506 is rotated relative to the fixed wall fitting 510 and fixed keyway 508, the valve body 506 will move axially as the keyway wall exerts an axial force on the key 504. Thus, utilization of the key and keyway in assembly 500, lieu of the threaded coupling between the valve body and wall fitting in assembly 300, enables the axial movement of the valve body to be restricted to a specific portion of the rotational range of the valve body. This is represented in the foregoing Table IV wherein it should be noted that the water entrainment path remains closed through substantially the initial 90°. This permits the momentum of the discharge stream to be varied over a wider range than in the assembly 300 of FIGS. 8–13.

In all other respects, the assembly 500 is identical to the assembly 300 except that whereas the tear drop shaped air hole 376 was skewed axially in assembly 300 (FIG. 14) to compensate for valve body axial movement within the rotational range of the air entrainment mode, such skewing is not necessary in assembly 500 because valve body 344 does not move axially within the rotational range associated with the air entrainment mode.

From the foregoing, it should now be recognized that several embodiments of improved hydrotherapy jet assemblies have been disclosed herein, characterized by structures which enable a user to operate the assembly in either an air entrainment mode or a water entrainment mode with the user having the ability, with a single control member, to vary the momentum of the discharge stream in either mode. Although each of the disclosed embodiments can be selectively operated in either mode, it is pointed out that other embodiments of the invention may have more restricted capability. For example only, an embodiment which eliminates the air passageway and employs the valve body having the cage like cavity to retain the flow director for the purpose of controlling only water entrainment and water supply would still have significant utility. As a further example, water entrainment capability can be deleted from an embodiment in which the valve body and caged flow director are employed solely for controlling air entrainment and/or water supply.

As will no doubt be appreciated, embodiments of the invention can be constructed in various dimensions. However, as taught in applicants' parent application, it is preferable that the tub water entrainment passageway have an effective area equal to at least 20% of the difference between the nozzle outlet area and the tubular member discharge orifice area.

We claim:

1. A hydrotherapy jet assembly suitable for mounting in an opening of a water tube peripheral wall for discharging a water stream into said tub for impacting against a user's body, said assembly including:

housing means defining a mixing chamber and including means for discharging a water jet along a defined water jet axis into said chamber for creating a suction therein;

tubular flow direction means having an inlet orifice and discharge orifice;

means mounting said flow director means with said inlet orifice open to said mixing chamber and substantially aligned with said water jet axis whereby water supplied by said jet will flow through said flow director means to said discharge orifice;

first passageway means for passing water from said tub into said chamber, drawn by said suction, for entrainment by said water jet, said first passageway means including first valve means for selectively varying the flow therethrough;

second passageway means for passing air into said chamber, drawn by said suction, for entrainment by said water jet, said second passageway means including second valve means for selectively varying the flow therethrough;

a manual control means; and means coupling said control means to said first and second valve means for selectively varying flow through said first and second passageway means.

2. A hydrotherapy jet assembly suitable for mounting in an opening of a water tube peripheral wall for discharging a water stream into said tub for impacting against a user's body, said assembly including:

housing means defining a mixing chamber and including means for discharging a water jet along a defined water jet axis into said chamber for creating a suction therein;

tubular flow director means having an inlet orifice and a discharge orifice;

means mounting said flow director means with said inlet orifice open to said mixing chamber and substantially aligned with said water jet axis whereby water supplied by said jet will flow through said flow director means to said discharge orifice;

first passageway means for passing water from said tub into said chamber, drawn by said suction, for entrainment by said water jet, said first passageway means including first valve means for selectively varying the flow therethrough;

second passageway means for passing air into said chamber, drawn by said suction, for entrainment by said water jet, said second passageway means including second valve means for selectively varying the flow therethrough; and third valve means for varying the magnitude of said water jet discharged into said chamber.

3. The assembly of claim 2 including a manual control means; and means coupling said control means to said first, second, and third valve means for respectively varying the magnitudes of said water available for entrainment, said air available for entrainment, and said water jet.

4. The assembly of claim 3 wherein said control means includes a ring member mounted for rotational movement; and trim ring means for overlaying said ring member.

5. The assembly of claim 1 wherein said housing means includes a flange for engaging said tub peripheral wall around said opening; and trim ring means for overlaying said flange.

6. The assembly of claim 1 wherein said control means includes a ring member mounted for rotational movement; and trim ring means for overlaying said ring member.

7. A hydrotherapy jet assembly comprising:

a housing defining an interior mixing chamber having an inlet end and an outlet end;

nozzle means for supplying a water jet along a defined axis to said chamber inlet end to create a reduced pressure in said chamber;

a tubular member defining an interior flow path having an inlet orifice and a discharge orifice;

means mounting said tubular member adjacent to said chamber outlet end, said mounting means including means defining a first passageway for passing water exteriorly of said tubular member interior flow path from proximate said tubular member discharge orifice into said chamber; and control means for selectively varying (1) the effective area of said first passageway and (2) the magnitude of said supplied water jet.

8. A hydrotherapy jet assembly comprising:

a housing defining an interior mixing chamber having an inlet end and an outlet end;

nozzle means for supplying a water jet along a defined axis to said chamber inlet end to create a reduced pressure in said chamber;

a tubular member defining an interior flow path having an inlet orifice and a discharge orifice;

means mounting said tubular member adjacent to said chamber outlet end, said mounting means including means defining a first passageway for passing water exteriorly of said tubular member interior flow path from proximate said tubular member discharge orifice into said chamber;

control means for selectively varying the water flow through said first passageway, said control means including:

a valve body having a central opening extending therethrough;

means mounting said valve body in said housing with said central opening oriented substantially along said nozzle axis;

a plurality of axially projecting fingers extending from said valve body to define a cavity therebetween; and wherein said tubular member is mounted in said cavity.

9. The assembly of claim 8 wherein said tubular member includes a portion having a substantially spherical exterior surface; and wherein said tubular member spherical surface engages said fingers in said cavity to permit said tubular member to swivel relative to said fingers for selectively orienting said discharge orifice.

10. The assembly of claim 7 wherein said control means includes:

a valve body having a central opening extending therethrough; and means mounting said valve body in said housing for axial movement along a central axis coincident with said nozzle axis.

11. The assembly of claim 10 wherein said control means further includes means for varying water flow through said first passageway dependent on the axial position of said valve body.

12. The assembly of claim 10 wherein said control means further includes means for varying air flow through said second passageway dependent on the axial position of said valve body.

13. The assembly of claim 10 wherein said control means further includes a control member mounted exteriorly of said housing for manual rotation; and means responsive to rotation of said control member for moving said valve body axially.

14. The assembly of claim 7 wherein said control means includes:

a valve body having a central opening extending therethrough; and means mounting said valve body in said housing for axial movement along a central axis coincident with said nozzle axis and rotational movement around said central axis.

15. The assembly of claim 14 wherein said control means further includes a control member mounted exteriorly of said housing for manual rotation; and means responsive to rotation of said control member for moving said valve body both axially and rotationally.

16. A hydrotherapy jet assembly comprising:

a housing defining an interior mixing chamber having an inlet end and an outlet end;

nozzle means for supplying a water jet along a defined axis to said chamber inlet end to create a reduced pressure in said chamber;

a tubular member defining an interior flow path having an inlet orifice and a discharge orifice;

means mounting said tubular member adjacent to said chamber outlet end, said mounting means including means defining a first passageway for passing water exteriorly of said tubular member interior flow path from proximate said tubular member discharge orifice into said chamber;

said housing defining a second passageway for coupling an air source to said chamber; and control means including a valve body for varying the effective area of said first passageway dependent on the axial position of said valve body and for varying the effective area of said second passageway dependent on the rotational position of said valve body.

17. In combination:

a tube for containing a water pool, said tub having a peripheral wall including a jet opening and a water return opening formed therein;

a housing mounted in alignment with said jet opening, said housing defining a mixing chamber and including nozzle means for supplying a water jet along a defined axis into said chamber for creating a suction therein;

electrically driven pump means having an inlet side coupled to said water return opening and an outlet side coupled to said nozzle means for drawing tub pool water and supplying pressurized water to said nozzle means;

first passageway means open to said water pool and communicating with said chamber for passing water from said pool into said chamber, drawn by said suction, for entrainment by said water jet;

second passageway means open to a source of air and communicating with said chamber for passing air, drawn by said suction, for entrainment by said water jet;

first valve means for varying the flow of water through said first passageway means;

second valve means for varying the flow of air through said second passageway means; and manually operable control means for controlling said first and second valve means.

18. The combination of claim 17 wherein said control means comprises a single control member mounted for rotation; and means coupling said control member to said first and second valve means.

19. In combination:

a tub for containing a water pool, said tub having a peripheral wall including a jet opening and a water return opening formed therein;

a housing mounted in alignment with said jet opening, said housing defining a mixing chamber and including nozzle means for supplying a water jet along a defined axis into said chamber for creating a suction therein;

electrically driven pump means having an inlet side coupled to said water return opening and an outlet side coupled to said nozzle means for drawing tub pool water and supplying pressurized water to said nozzle means;

first passageway means open to said water pool and communicating with said chamber for passing water from said pool into said chamber, drawn by said suction, for entrainment by said water jet;

second passageway means open to a source of air and communicating with said chamber for passing air, drawn by said suction, for entrainment by said water jet;

first valve means for varying the flow of water through said first passageway means;

second valve means for varying the flow of air through said second passageway means; and third valve means for varying the magnitude of said supplied water jet.

20. The combination of claim 19 including a manually operable control member; and means coupling said control member to said first, second, and third valve means.

21. A hydrotherapy jet assembly comprising:

a housing defining an interior mixing chamber having an inlet end and an outlet end;

nozzle means for supplying a water jet along a defined axis to said chamber inlet end to create a reduced pressure in said chamber;

a tubular member defining an interior flow path having an inlet orifice and a discharge orifice;

water source means for supplying water to said nozzle means;

control means for selectively varying the water flow from said water source means;

said control means including a valve body having at least one central opening extending therethrough;

means mounting said valve body in said housing with said central opening oriented substantially along said defined axis;

a plurality of axially projecting fingers extending from said valve body to define a cavity therebetween; and wherein said tubular member is mounted in said cavity.

22. The assembly of claim 21 wherein said tubular member includes a portion having a substantially spherical exterior surface; and wherein said tubular member spherical surface engages said fingers in said cavity to permit said tubular member to swivel relative to said fingers for selectively orienting said discharge orifice.

23. The assembly of claim 21 wherein said means mounting said valve body permits rotation of said valve body around said defined axis.

24. The assembly of claim 21 wherein said housing includes a flange for engaging a tub peripheral wall around an opening therein; and trim ring means for overlaying said flange.

25. The assembly of claim 21 wherein said control means includes a ring member mounted for rotational movement; and trim ring means for overlaying said ring member.

26. A hydrotherapy jet assembly comprising:

a housing defining an interior mixing chamber having an inlet end and an outlet end;

nozzle means for supplying a water jet along a defined axis to said chamber inlet end to create a reduced pressure in said chamber;

a tubular member defining an interior flow path having an inlet orifice and a discharge orifice;

means mounting said tubular member adjacent to said chamber outlet end, said mounting means including means defining a first passageway, exteriorly of said tubular member interior flow path for passing water from proximate said tubular member discharge orifice into said chamber;

water source means for supplying water to said nozzle means; and a manual control means for selectively varying the (1) effective area of said first passageway and (2) the water flow from said water source means.

27. The assembly of claim 26 wherein said control means includes:

a valve body having at least one opening extending therethrough;

means mounting said valve body in said housing with said opening oriented substantially along said nozzle axis;

a plurality of axially projecting fingers extending from said valve body to define a cavity therebetween; and wherein said tubular member is mounted in said cavity.

28. The assembly of claim 27 wherein said tubular member includes a portion having a substantially spherical exterior surface; and wherein said tubular member spherical surface engages said fingers in said cavity to permit said tubular member to swivel relative to said fingers for selectively orienting said discharge orifice.

29. The assembly of claim 27 wherein said means mounting said valve body permits rotation of said valve body around said defined axis.

30. The assembly of claim 26 wherein said housing includes a flange for engaging a tub peripheral wall around an opening therein; and trim ring means for overlaying said flange.

31. The assembly of claim 26 wherein said control means includes a ring member mounted for rotational movement; and trim ring means for overlaying said ring member.

32. A method of operating a hydrotherapy jet assembly to discharge a high intensity stream through an opening in the peripheral wall of a water tub beneath the surface of a water pool contained therein, which assembly includes a nozzle for discharging a water jet into a mixing chamber to create a suction at a suction inlet to said chamber and an orifice for discharging a stream from said chamber, said method including the steps of:

pumping water from said water pool and supplying it under pressure to said nozzle to produce said water jet;

providing a first passageway from said water pool to said suction inlet for drawing water from said pool for entrainment by said water jet;

providing a second passageway from an air source to said suction inlet for drawing air for entrainment by said water jet; and selectively varying the effective areas of said first and second passageways to control the amount of water and air drawn for entrainment.

33. The method of claim 32 including the further step of selectively controlling the water supplied to said nozzle.

34. A method of operating a hydrotherapy jet assembly to discharge a high intensity stream through an opening in the peripheral wall of a water tub beneath the surface of a water pool contained therein, which assembly includes a nozzle for discharging a water jet into a mixing chamber to create a suction at a suction inlet to said chamber and an orifice for discharging a stream from said chamber said method including the steps of:

pumping water from said water pool and supplying it under pressure to said nozzle to produce said water jet;

providing a passageway from said water pool to said suction inlet for drawing water from said pool for entrainment by said water jet; and selectively varying the amount of water supplied to said nozzle and the effective area of said passageway.

35. The assembly of claim 2 wherein said housing means includes a flange for engaging said tub peripheral wall around said opening; and trim ring means for overlaying said flange.

36. The assembly of claim 21 further including: air source means for supplying air to said chamber; and wherein said control means further includes means for selectively varying the air flow from said air source means.

* * * * *

US004982459C1

(12) REEXAMINATION CERTIFICATE (4322nd)

United States Patent

Henkin et al.

(10) Number: US 4,982,459 C1

(45) Certificate Issued: May 1, 2001

(54) ADJUSTABLE AIR AND WATER ENTRAINMENT HYDROTHERAPY JET ASSEMBLY

(75) Inventors: Melvyn L. Henkin, 5011 Donna Ave., Tarzana, CA (US) 91356; Jordan M. Laby, 3038 Bayshore, Ventura, CA (US) 93001

(73) Assignees: Melvyn L. Henkin, Tarzana; Jordan M. Laby, Ventura, both of CA (US)

Reexamination Request:
No. 90/005,569, Nov. 24, 1999

Reexamination Certificate for:

| | |
|---|---|
| Patent No.: | **4,982,459** |
| Issued: | **Jan. 8, 1991** |
| Appl. No.: | **07/170,718** |
| Filed: | **Mar. 21, 1988** |

Related U.S. Application Data

(63) Continuation-in-part of application No. 07/064,138, filed on Jun. 19, 1987, now Pat. No. 4,731,887.

(51) Int. Cl.[7] ..... A61H 33/02; E03C 1/02

(52) U.S. Cl. ..... 4/541.4; 4/492; 4/496; 4/541.6; 601/160

(58) Field of Search ..... 4/541.6

(56) References Cited

U.S. PATENT DOCUMENTS

| | | | | |
|---|---|---|---|---|
| 3,297,025 | | 1/1967 | Jacuzzi | 4/541.6 |
| 4,335,854 | | 6/1982 | Reynoso | 239/428.5 |
| 4,460,519 | | 7/1984 | Leggett | 4/541.6 X |
| 4,512,934 | | 4/1985 | Bucher | 261/64.3 |
| 4,541,780 | * | 9/1985 | Moreland | 4/541.6 |
| 4,742,965 | | 5/1988 | Messinger et al. | 4/541.6 |
| 4,800,046 | * | 1/1989 | Malek et al. | 4/541.6 X |

* cited by examiner

*Primary Examiner*—Robert M. Fetsuga

(57) ABSTRACT

A hydrotherapy jet assembly capable of operating in either an entrainment mode and/or a tub water entrainment mode. The assembly incorporates a valve means including a rotatable control member which allows a user to selectively vary the amount of supplied water jet and/or air available for entrainment and/or tub water available for entrainment.

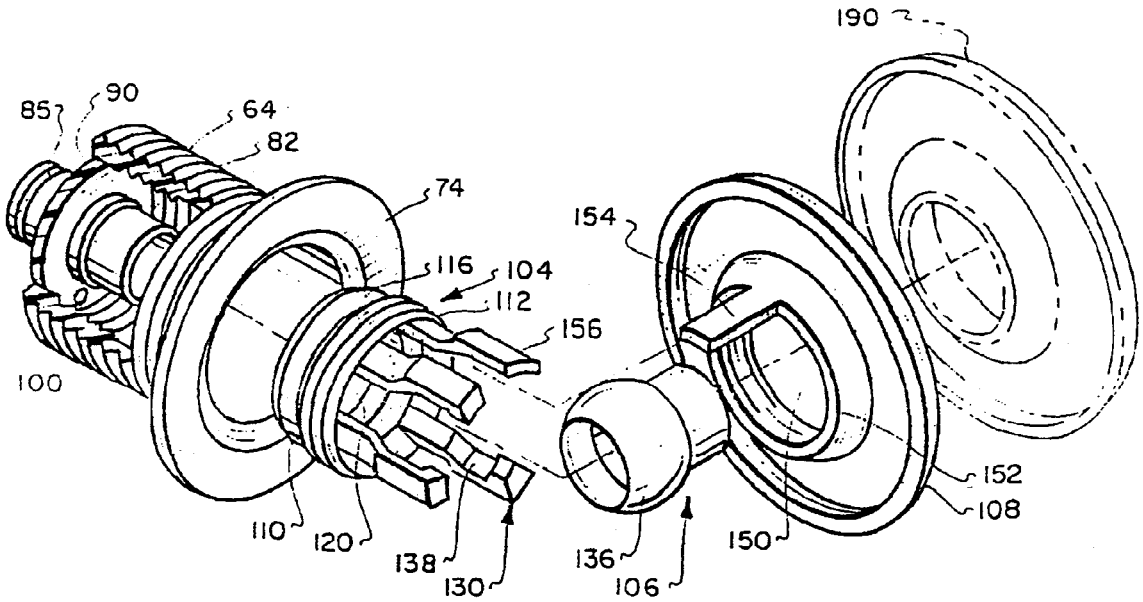

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–20 and 26–35 is confirmed.

Claim 21 is determined to be patentable as amended.

Claims 22–25 and 36, dependent on an amended claim, are determined to be patentable.

21. A hydrotherapy jet assembly comprising:

a housing defining an interior mixing chamber having an inlet end and an outlet end;

nozzle means for supplying a water jet along a defined axis to said chamber inlet end to create a reduced pressure in said chamber;

a tubular member defining an interior flow path having an inlet orifice and a discharge orifice;

water source means for supplying water to said nozzle means;

control means for selectively varying the water flow from said water source means;

said control means including a valve body having at least one central opening extending therethrough;

means mounting said valve body in said housing with said central opening oriented substantially along said defined axis;

a plurality of axially projecting fingers *having free ends and* extending from said valve body to define a cavity therebetween; and wherein said tubular member is [mounted] *retained by said fingers* in said cavity.

* * * * *